US008410723B2

(12) United States Patent
Deurenberg et al.

(10) Patent No.: US 8,410,723 B2
(45) Date of Patent: Apr. 2, 2013

(54) DESCRIBING TWO LED COLORS AS A SINGLE, LUMPED LED COLOR

(75) Inventors: Peter Hubertus Franciscus Deurenberg, Eindhoven (NL); Johannes Petrus Maria Ansems, Eindhoven (NL); Christoph Gerard August Hoelen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 306 days.

(21) Appl. No.: 11/914,979

(22) PCT Filed: May 11, 2006

(86) PCT No.: PCT/IB2006/051483

§ 371 (c)(1), (2), (4) Date: Nov. 20, 2007

(87) PCT Pub. No.: WO2006/126124

PCT Pub. Date: Nov. 30, 2006

(65) Prior Publication Data

US 2008/0203945 A1 Aug. 28, 2008

(30) Foreign Application Priority Data

May 25, 2005 (EP) ..... 05104441

(51) Int. Cl.
*H05B 37/00* (2006.01)

(52) U.S. Cl. ..... 315/312; 362/230

(58) Field of Classification Search ..... 315/178, 315/179, 185 R, 192, 185 S, 291, 294, 299, 315/300, 302, 307, 308, 309, 312, 324; 362/800, 362/3, 5, 6, 11, 227, 230, 231

See application file for complete search history.

(56) References Cited

U.S. PATENT DOCUMENTS

| | | | | |
|---|---|---|---|---|
| 6,411,046 | B1 | 6/2002 | Muthu | |
| 6,441,558 | B1 | 8/2002 | Muthu et al. | |
| 6,513,949 | B1 | 2/2003 | Marshall et al. | |
| 7,145,125 | B2 * | 12/2006 | May et al. | 250/228 |
| 2003/0063462 | A1 | 4/2003 | Shimizu et al. | |
| 2004/0183475 | A1 | 9/2004 | Boulouednine et al. | |
| 2004/0240890 | A1 | 12/2004 | Lys et al. | |

* cited by examiner

FOREIGN PATENT DOCUMENTS

WO 2004047498 A1 6/2004

*Primary Examiner* — Douglas W Owens
*Assistant Examiner* — Jianzi Chen
(74) *Attorney, Agent, or Firm* — John F. Salazar; Mark L. Beloborodov

(57) ABSTRACT

A light emitting diode (LED) lighting system for producing white light is disclosed. The system comprises sets of LEDs arranged to emit light with different wavelength ranges and associated with different sets of characteristics, and a driving circuit arranged to drive the LEDs. The driving circuit comprises an input for desired light intensity, color rendering index, and color temperature, an input for signals for LED temperature, a model for determining driving currents for said sets of LEDs from said parameters, signals, and characteristics for each of said sets of LEDs; and a current driver for the LEDs. At least one of the sets of LEDs comprises a first subset of LEDs with a first wavelength sub-range and a first set of characteristics, and a second subset of LEDs with a second wavelength sub-range and a second set of characteristics. A lumped wavelength range of the set of LEDs is a range of said first and second wavelength sub-ranges, and the set of characteristics of the set of LEDs is a function of said first and second sets of characteristics. A method for controlling the sets of LEDs is also disclosed.

8 Claims, 3 Drawing Sheets

DESCRIBING TWO LED COLORS AS A SINGLE, LUMPED LED COLOR

TECHNICAL FIELD

The present invention relates to a light emitting diode (LED) lighting system for producing white light, and a method for controlling three or more sets of LEDs for providing white light.

BACKGROUND OF THE INVENTION

A current issue for a color adjustable light emitting diode (LED) light source is color rendering properties. To obtain a sufficiently large color gamut, the light source normally comprises three color LEDs: red, green, and blue. This is described in U.S. Pat. No. 6,411,046, where light output and the color of the LEDs are controlled by measuring color coordinates for each LED light source for different temperatures, storing the expressions of the color coordinates as a function of the temperatures, deriving equations for the color coordinates as a function of temperature, calculating the color coordinates and lumen output fractions on-line, and controlling the light output and color of the LEDs based upon the calculated color coordinates and lumen based upon the calculated color coordinates and lumen output fractions. However, the demand on calculation power will increase cost of the lighting system. Further, the color rendering properties of a three-color system may not be satisfactory. Note that the color rendering index can only be optimized by choosing the wavelengths of the LEDs when designing the lighting system. This can be overcome by using more colors. However, the demand on calculation power would then raise even more, and thus the cost. Therefore, there is a need for an improved LED lighting system, and an improved method of controlling such a LED lighting system.

SUMMARY OF THE INVENTION

In view of the above, an objective of the invention is to solve or at least reduce the problems discussed above. In particular, an objective is to improve optimization of color rendering in sense of complexity.

The present invention is based on the understanding that complexity in controlling color rendering can be reduced by driving LEDs of different colors jointly, and how this can be implemented to obtain satisfactory color rendering and control properties although changes in temperature of the LEDs.

According to a first aspect of the present invention, there is provided a light emitting diode (LED) lighting system for producing white light, the system comprising a first set of LEDs arranged to emit light with a first wavelength range and a first set of characteristics; a second set of LEDs arranged to emit light with a second wavelength range and a second set of characteristics; a third set of LEDs arranged to emit light with a third wavelength range and a third set of characteristics; and a driving circuit arranged to drive said sets of LEDs. The driving circuit comprises an input for parameters determining desired light intensity and color; an input for signals for LED temperatures of the sets of LEDs; a model for determining driving currents for said sets of LEDs from said parameters, signals, and sets of characteristics for each of said sets of LEDs; and a current driver for providing said determined currents to said sets of LEDs. The system is characterized in that said third set of LEDs comprises a first subset of LEDs with a first wavelength sub-range and a first set of characteristics, and a second subset of LEDs with a second wavelength sub-range and a second set of characteristics, wherein said third wavelength range is a lumped wavelength range of said first and second wavelength sub-ranges, and said third set of characteristics is a function of said first and second sets of characteristics.

An advantage of this is improved color rendering without increased complexity of controlling. With the use of more than three colors, the color rendering index can be optimized after choosing the color to be generated.

Said sets of characteristics may comprise temperature dependency of light output, temperature dependency of wavelength, or current dependency of light output, or any combination thereof.

The first and second sub-set of light emitting diodes are electrically connected in series.

An advantage of this is that equal current is provided to the two sets of LEDs.

The lighting system may further comprise a temperature sensor for providing said signals for LED temperatures of the sets of LEDs, wherein said temperature sensor is arranged in a heat sink arranged at said sets of LEDs.

Said model for each set of LEDs may comprise a flux function of LED temperature being an exponential function of quotient of a difference between LED temperature and a reference temperature, and a flux dependency on temperature parameter according to the characteristics of each set of LEDs. Said model for each set of LEDs may comprise a wavelength function of LED temperature being dependent on a difference between LED temperature and a reference temperature, and a wavelength dependency on temperature parameter according to the characteristics of each set of LEDs.

According to a second aspect of the present invention, there is provided a method for controlling three sets of LEDs, each arranged to emit light with a wavelength range and with a set of characteristics, to provide white light, comprising the steps of: determining a desired light intensity and color; determining LED temperatures of the sets of LEDs; determining for each set of LEDs a driving current for each of said sets of LEDs from said desired light intensity and color, and said LED temperatures; and providing said driving currents to said sets of LEDs. The method is characterized in that at least one of said sets of LEDs comprises a first subset of LEDs with a first wavelength sub-range and a first set of characteristics, and a second subset of LEDs with a second wavelength sub-range and a second set of characteristics, wherein a wavelength range of said set of LEDs is a lumped wavelength range of said first and second wavelength sub-ranges, and a set of characteristics of said set of LEDs is a function of said first and second sets of characteristics.

Said step of determining for each set of LEDs a driving current for each of said sets of LEDs may use a model for each set of LEDs comprising a wavelength function of LED temperature being dependent on a difference between LED temperature and a reference temperature, and a wavelength dependency on temperature parameter according to the characteristics of each set of LEDs.

The sets of LEDs may comprise one or more LEDs.

By LED temperature, it is meant a temperature under which an LED works. Physically, this is the junction temperature; practically and measurably, this is a temperature of a medium close to the junction, e.g. the capsule of the LED or a heat sink at the LED.

By reference temperature, it is meant a nominal temperature, at which properties of e.g. an LED is specified.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

Other objectives, features and advantages of the present invention will appear from the following detailed disclosure, from the attached dependent claims as well as from the drawings.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF PREFERRED EMBODIMENTS

Figure 1:
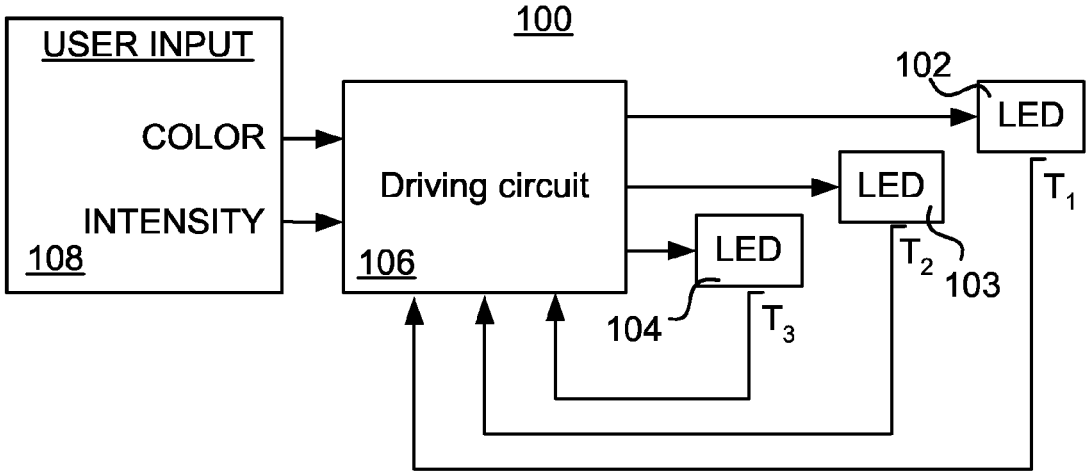
FIG. 1 shows a lighting system according to an embodiment of the present invention.

FIG. 1 shows a lighting system 100 according to an embodiment of the present invention, comprising sets of LEDs 102, 103, 104, a driving circuit 106, and an input 108 for desired light parameters, e.g. intensity and color. Each of the sets of LEDs 102, 103, 104 is arranged to emit light with a wavelength range and associated with a set of characteristics. The characteristics can be temperature dependency of light output, temperature dependency of wavelength and/or current dependency of light output. The driving circuit 106 is arranged to drive the sets of LEDs 102, 103, 104, e.g. by providing a determined driving current for each set of LEDs 102, 103, 104. The driving currents can be determined by a model, wherein the inputs to the model is desired light parameters provided by the input 108, characteristics of the sets of LEDs 102, 103, 104, and determined junction temperatures of the sets of LEDs 102, 103, 104. The LED temperatures, i.e. temperatures associated with the junction temperatures, are determined from measuring temperatures of e.g. the heat sinks of the LEDs, respectively. The control mechanism of the embodiment should be construed as an example, and other control mechanisms, known in the art, are equally possible. The system 100 has features, which will be further described with reference to FIGS. 3, 4, and 5.

Figure 2:
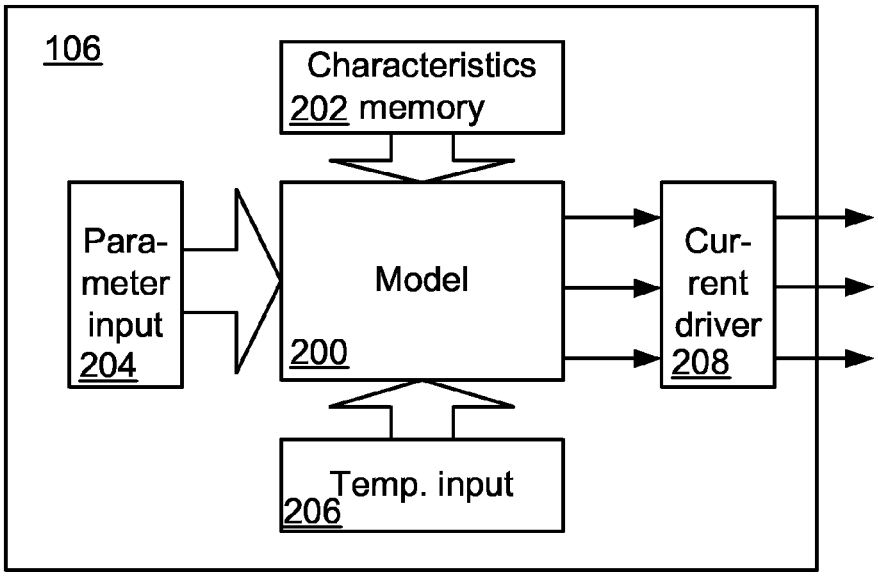
FIG. 2 is a functional description of a driving circuit according to an embodiment of the present invention.

FIG. 2 is a functional description of an embodiment of the driving circuit 106 of FIG. 1. The driving circuit 106 comprises a model 200, a memory 202 for characteristics of the sets of LEDs, a desired light parameter input 204, a LED temperature input 206, and a current driver 208. The model 200 is provided with characteristics, light parameters, and determined LED temperatures, and provides determined current levels for each of the sets of LEDs to the current driver 208, which provides the currents to the sets of LEDs (not shown). The driving circuit 106 has features, which will be further described with reference to FIGS. 3, 4, and 5.

Figure 3:
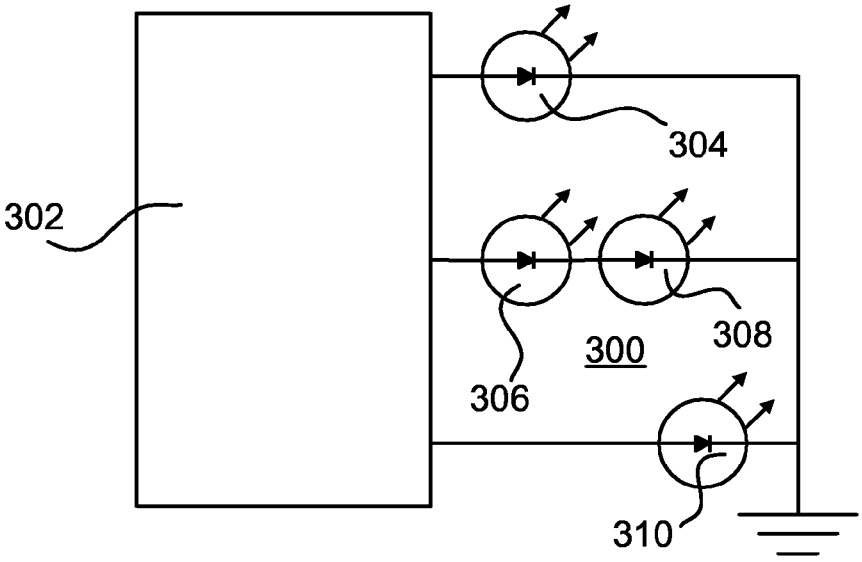
FIG. 3 shows a lighting system according to an embodiment of the present invention.

FIG. 3 schematically shows a lighting system 300 according to an embodiment of the present invention. The lighting system 300 comprises a driving circuit 302 arranged to provide three driving signals. Note that illustration of parts for determining the driving signals, which are described above with reference to FIGS. 1 and 2, have been omitted for the sake of clarity. A first driving signal is arranged to drive a first set of light emitting diodes (LEDs), here depicted as a single LED 304, which LEDs are arranged to emit light with a first wavelength range. A second driving signal from the driving circuit 302 is arranged to drive a second set of LEDs, which comprises a first subset of LEDs, here depicted as a single LED 306, which LEDs are arranged to emit light with a first wavelength sub-range and are associated with a first set of characteristics, and a second subset of LEDs, here depicted as a single LED 308, which LEDs are arranged to emit light with a second wavelength sub-range and associated with a second set of characteristics. The second set of LEDs is treated as a single set of LEDs although it comprises two subsets of LEDs with different wavelength ranges and different characteristics. Thus, the second set of LEDs is assigned a wavelength range that is a lumped wavelength range of the first and second wavelength sub-ranges. Similarly, the second set of LEDs is assigned characteristics which is a function of the first and second sets of characteristics. The first and second subset of LEDs 306, 308 can be electrically connected in series. A third driving signal is arranged to drive a third set of LEDs, here depicted as a single LED 310, which LEDs are arranged to emit light with a third wavelength range. By controlling the three driving signals, the sets of LEDs emit light in different colors to provide a total light output with a desired white light. Further, by the control of the three driving signals, color and intensity of the total light output can be controlled.

The sets of LEDs can comprise one or more LEDs. The number of LEDs in each set can be chosen to optimize the balance between the various wavelength to enable feasible control of provision of white light with a desired color and intensity.

The light of the first wavelength range can be green, i.e. the center wavelength is somewhere in the range of 520 nm to 550 nm. The light of the third wavelength range can be blue, i.e. the center wavelength is somewhere in the range of 450 nm to 490 nm. The first and second wavelength sub-ranges can be red and amber, respectively, i.e. center wavelengths somewhere in the range of 610 nm to 645 nm and 580 nm to 600 nm, respectively. Due to the nature of LEDs, wavelengths around the center wavelengths are also provided. Further, the center wavelength is dependent on the junction temperature of the LED.

The above wavelengths are examples, and other wavelengths and ranges of wavelengths are possible within the scope of the present invention.

The characteristics of the LEDs can be, apart from reference wavelength range, reference light output, reference temperature, etc from e.g. a data sheet of the LED, temperature dependency of wavelength and light output. Empirically, it is found that light output (flux) can be derived from for example $$\Phi(T_j) = \Phi_{ref} \exp\left(-\frac{T_j - T_{ref}}{T_0}\right), \quad \text{(Eq. 1)}$$

where $T_0$ is a characteristic variable. Further, peak wavelength shift can be described for example by the empirically found relation $$\lambda_p \sim \lambda_{p0} + \beta(T_j - T_{ref}), \quad \text{(Eq. 2)}$$

where β is a characteristic property. The values of the characteristics are different for LEDs of different color, as can be seen in exemplary Table 1.

TABLE 1

| LED color | RED | AMBER | GREEN | BLUE |
|---|---|---|---|---|
| β (nm/K) | 0.10 | 0.13 | 0.05 | 0.02 |
| $T_0$ (K) | 95 | 65 | 260 | 400 |

The differences in characteristics means that it is not clear that a combination of red and amber LEDs can be seen as a single lumped LED. Earlier tests with a color feedback system utilizing these four colors showed that the differences in temperature behaviour are too significant to just lump the red and amber LEDs in a single degree of freedom, while only taking the optical properties at a single temperature into account. The combined LED can be modeled as a lumped LED with a similar radiation pattern and behaviour as a normal LED. By simulation, radiation pattern in both x- and y-coordinates and flux output of the combined red and amber LED is determined. Table 2 shows an example of a simulation.

TABLE 2

| | RED | AMBER | LUMPED |
|---|---|---|---|
| # of LEDs | 2 | 6 | "1" |
| I (mA) | 350 | 350 | 350 |
| ϕ (lm/LED) | 59.5 | 45.8 | 320.0 |
| FWHM (nm) | 20 | 14 | 14 |
| $\lambda_{peak}$ (nm) | 617 | 593.25 | 598.25 |
| β (nm/K) | 0.10 | 0.13 | 0.13 |
| $T_0$ (K) | 95 | 65 | 68 |
| $R_{j2b}$ (K/W) | 18 | 18 | 18 |
| $V_F$ (V) | 2.910 | 2.670 | 2.730 |

Based on the simulation results of Table 2, the combination of 6 amber and 2 red LEDs yields both very good color rendering properties and easy driving, color feedback, and color adjustability. Easy, because there are only three degrees of freedom, which are explicitly determined by choosing a desired color-point. Note that a similar lumped LED can also be defined for a different combination of red and amber LEDs, or for a different combination of colors, e.g. blue and cyan, blue and green, or green and cyan LEDs.

Figure 4:
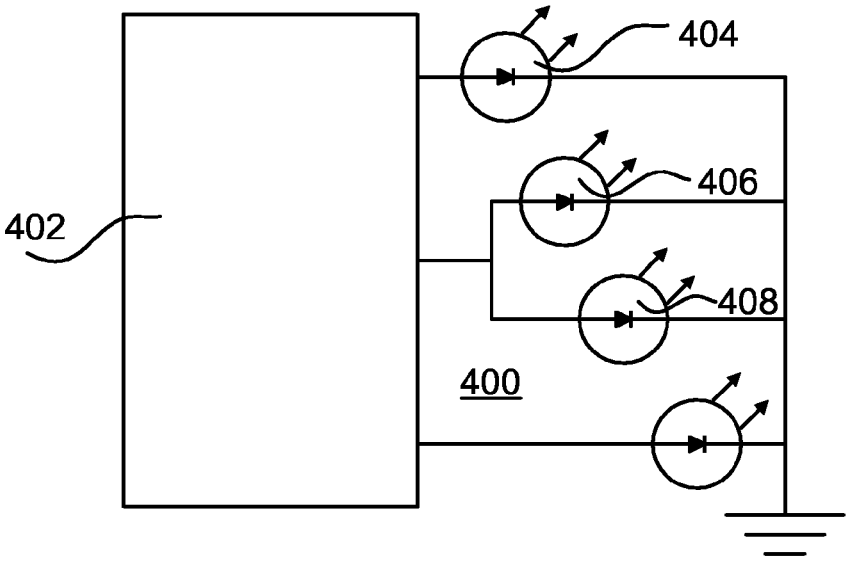
FIG. 4 shows a lighting system according to an embodiment of the present invention.

In an alternative embodiment, it can be desirable to provide equal voltage for the sets being jointly driven. FIG. 4 shows a lighting system 400 according to an embodiment of the present invention. The lighting system 400 comprises a driving circuit 402 arranged to provide three driving signals. Note that illustration of parts for determining the driving signals, which are described above with reference to FIGS. 1 and 2, have been omitted for the sake of clarity. A first driving signal is arranged to drive a first set of LEDs, here depicted as a single LED 404, which LEDs are arranged to emit light with a first wavelength range. A second driving signal from the driving circuit 402 is arranged to drive a second set of LEDs comprising a first subset of LEDs, here depicted as a single LED 406, which LEDs are arranged to emit light with a first wavelength sub-range, and a second subset of LEDs, here depicted as a single LED 408, which LEDs are arranged to emit light with a second wavelength sub-range. The second set of LEDs is treated as a single set of LEDs although it comprises two sets of LEDs with different wavelength ranges and different characteristics. Thus, the second set of LEDs is assigned a wavelength range that is a lumped wavelength range of the first and second wavelength sub-ranges. Similarly, the second set of LEDs is assigned characteristics which is a function of the first and second subsets of characteristics. The first and second subset of LEDs can be electrically connected in parallel to provide equal voltage for the two subsets of LEDs 406, 408.

Figure 5:
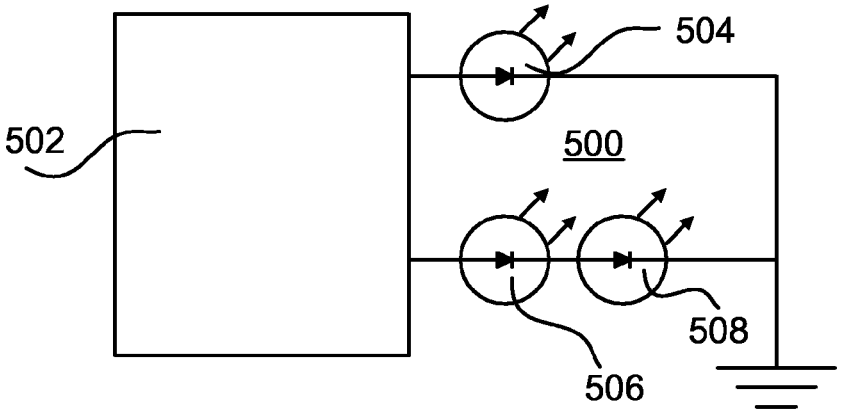
FIG. 5 shows a lighting system according to an embodiment of the present invention.

FIG. 5 shows a lighting system 500 according to an embodiment of the present invention, where only two driving signals are provided. The lighting system 500 comprises a driving circuit 502 arranged to provide two driving signals. A first driving signal is arranged to drive a first set of light emitting diodes (LEDs), here depicted as a single LED 504, which LEDs are arranged to emit light with a first wavelength. A second driving signal from the driving circuit 502 is arranged to drive a second set of LEDs comprising a first subset of LEDs, here depicted as a single LED 506, which LEDs are arranged to emit light with a first wavelength sub-range, and a second subset of LEDs, here depicted as a single LED 508, which LEDs are arranged to emit light with a second wavelength sub-range. The second set of LEDs is treated as a single set of LEDs although it comprises two subsets of LEDs with different wavelength ranges and different characteristics. Thus, the second set of LEDs is assigned a wavelength range that is a lumped wavelength range of the first and second wavelength sub-ranges. Similarly, the second set of LEDs is assigned characteristics which is a function of the first and second sets of characteristics. The first and second subset of LEDs can be electrically connected in series to provide equal current for the two sets 506, 508.

The sets and subsets of LEDs can comprise one or more LEDs. The number of LEDs and wavelength in each set and subset can be chosen to optimize the balance between the various wavelength to enable control of provision of white light with a desired color temperature range and color rendering index, color and intensity. The number of LEDs per color and their wavelength should be optimized for a certain color rendering in a desired color temperature range, color range and light intensity range.

The light of the first wavelength can be red, i.e. the center wavelength is somewhere in the range of 610 nm to 645 nm. The colors of the first and second subsets of LEDs can be blue and green, respectively, i.e. center wavelengths somewhere in the range of 450 nm to 490 nm and 520 nm to 550 nm, respectively.

The above embodiments of the present invention suggest driving more than one subset of LEDs jointly to facilitate control of color temperature of generated white light. Suggestions have been made to reduce a four-color system to three degrees of freedom and to reduce a three-color system to two degrees of freedom. However, the present invention can be used to implement a system with any number of colors with a reduced number of freedoms of control. Thus, a lighting system can comprise two or more lumped sets of LEDs similar to what is described above.

Figure 6:
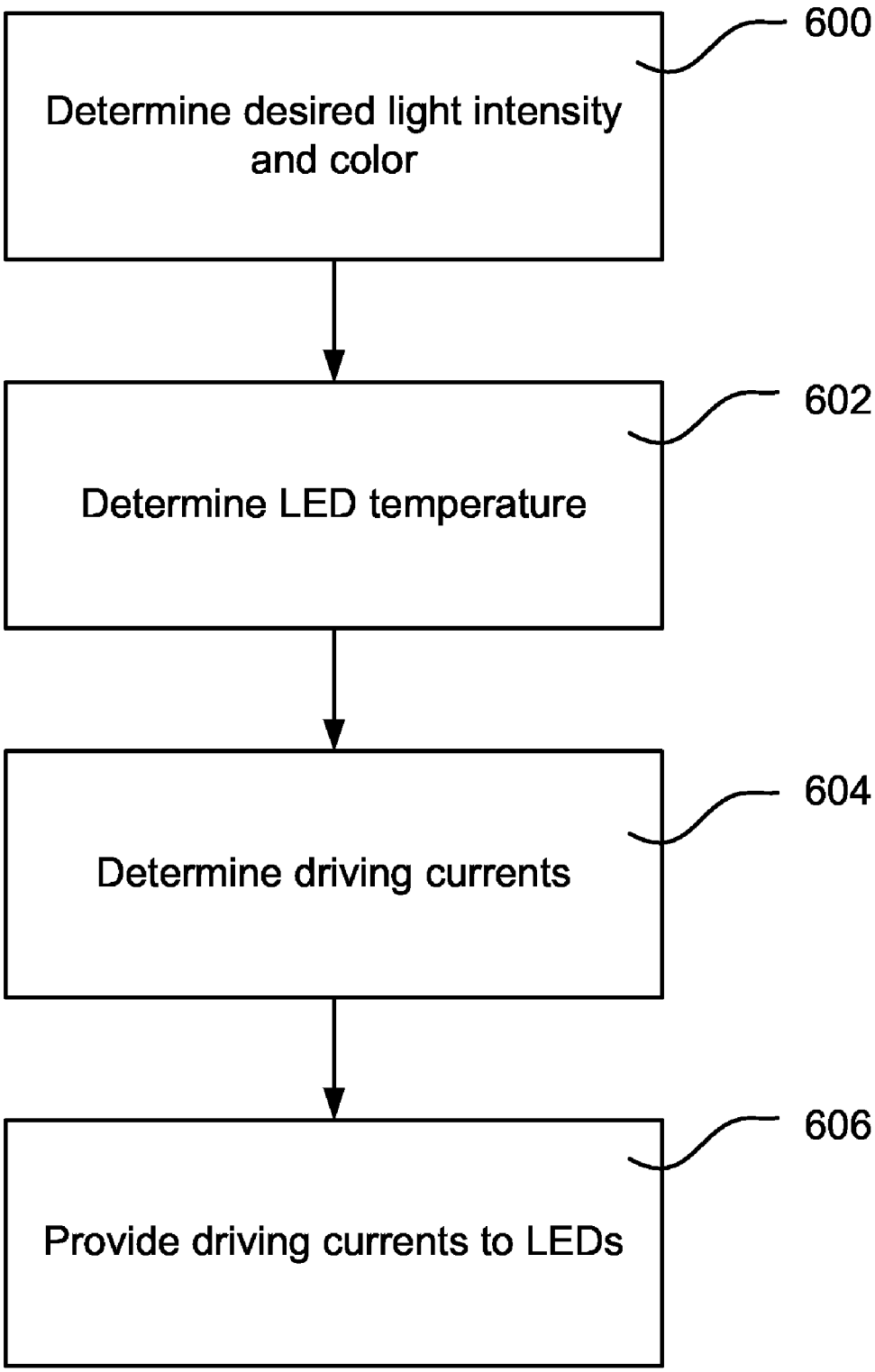
FIG. 6 is a flow chart illustrating a method for controlling LEDs according to an embodiment of the present invention.

FIG. 6 is a flow chart illustrating a method for controlling a plurality of sets of LEDs according to an embodiment of the present invention. In a first determining step 600, a desired light intensity, color rendering index, and color temperature is determined. In a second determining step 602, LED temperatures are determined, preferably the junction temperatures, e.g. by measuring temperatures of heat sinks of the LEDs and determining the junction temperatures of the LEDs from the temperatures of the heat sinks. In a third determining step 604, driving currents for each of the sets of LEDs are determined from the desired light intensity, color rendering index, and color temperature, and the LED temperatures. In a current provision step 606, driving currents are provided to each of the sets of LEDs. Further, the method comprises features according to what described above with reference to FIGS. 3, 4, and 5.

The methods according to the described embodiments of the present invention comprises a number of steps. The steps can be performed in any order, consecutively or parallelly, due to the real-time constraints of the art.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A light emitting diode (LED) lighting system for producing white light, the system comprising a first set of LEDs arranged to emit light with a first wavelength range and a first set of characteristics;

a second set of LEDs arranged to emit light with a second wavelength range and a second set of characteristics;

a third set of LEDs arranged to emit light with a third wavelength range and a third set of characteristics; and a driving circuit arranged to drive said sets of LEDs, comprising an input for parameters determining desired light intensity and color;

an input for signals for LED temperatures of the sets of LEDs;

a model for determining driving currents for said sets of LEDs from said parameters, signals, and sets of characteristics for each of said sets of LEDs; and a current driver for providing said determined currents to said sets of LEDs wherein, said third set of LEDs comprises a first subset of LEDs with a first wavelength sub-range and a fourth set of characteristics, and a second subset of LEDs with a second wavelength sub-range different than said first wavelength sub-range and a fifth set of characteristics, wherein said third wavelength range is a lumped wavelength range of said first and second wavelength sub-ranges, and said third set of characteristics is a function of said fourth and fifth sets of characteristics.

2. The lighting system according to claim 1, wherein said sets of characteristics comprise temperature dependency of light output, temperature dependency of wavelength, or current dependency of light output, or any combination thereof.

3. The lighting system according to claim 1, wherein said first wavelength range is from 450 nm to 490 nm, said second wavelength range is from 520 nm to 550 nm, said third wavelength range is from 580 nm to 645 nm, wherein said third wavelength is a lumped wavelength range of a first sub-range from 580 nm to 600 nm and a second sub-range from 610 nm to 645 nm.

4. The lighting system according to claim 1, wherein said first wavelength range is from 610 nm to 645 nm, said second wavelength range is from 580 nm to 600 nm, said third wavelength is from 450 nm to 550 nm, wherein said third wavelength is a lumped wavelength range of a first sub-range from 450 nm to 490 nm, and a second sub-range from 520 nm to 550 nm.

5. The lighting system according to claim 1, wherein said first and second sub-set of light emitting diodes are electrically connected in series.

6. The lighting system according to claim 1, further comprising a temperature sensor for providing said signals for LED temperatures of the sets of LEDs, wherein said temperature sensor is arranged in a heat sink arranged at said sets of LEDs.

7. The lighting system according to claim 1, wherein said model for each set of LEDs comprises a wavelength function of LED temperature being dependent on a difference between LED temperature and a reference temperature, and a wavelength dependency on temperature parameter according to the characteristics of each set of LEDs.

8. A light emitting diode (LED) lighting system for producing white light, the system comprising a first set of LEDs arranged to emit light at a first wavelength and a first set of characteristics;

a second set of LEDs arranged to emit light at a second wavelength and a second set of characteristics;

a third set of LEDs arranged to emit light at a third wavelength and a third set of characteristics;

a driving circuit operably connected to said first set, said second set and said third set of LEDs, said driving circuit having an input for parameters determining desired lighting system light intensity and light color;

an input for signals for LED temperatures of said first, second and third sets of LEDs;

a model for determining driving currents for said first, second and third sets of LEDs from said parameters, signals, and sets of characteristics for each of said sets of LEDs; and a current driver for providing said determined currents to said sets of LEDs wherein, said third set of LEDs comprises a first subset of LEDs with a first wavelength sub-range and a fourth set of characteristics, and a second subset of LEDs with a second wavelength sub-range different than said first wavelength sub-range and a fifth set of characteristics, wherein said third wavelength range is a lumped wavelength range of said first and second wavelength sub-ranges, and said third set of characteristics is a function of said fourth and fifth sets of characteristics;

wherein said first wavelength range is from 450 nm to 490 nm, said second wavelength range is from 520 nm to 550 nm, said third wavelength range is from 580 nm to 645 nm, wherein, said third wavelength is a lumped wavelength range of a first sub-range from 580 nm to 600 nm and a second sub-range from 610 nm to 645 nm;

and further having a temperature sensor for providing said signals for LED temperatures of the sets of LEDs, wherein said temperature sensor is arranged in a heat sink arranged at said sets of LEDs.

* * * * *